US005692732A

United States Patent [19]

Gill

[11] Patent Number: 5,692,732

[45] Date of Patent: Dec. 2, 1997

[54] TUBULAR D-SHAPED TRUNNION

[75] Inventor: Bryan D. Gill, Newmarket, Canada

[73] Assignee: Ventra Group Inc., Ontario, Canada

[21] Appl. No.: 551,750

[22] Filed: Nov. 7, 1995

[51] Int. Cl.[6] ..... B66F 3/22

[52] U.S. Cl. ..... 254/126; 411/103

[58] Field of Search ..... 411/103, 108, 411/116, 120, 121, 104, 169; 254/126, 122, 124

[56] References Cited

U.S. PATENT DOCUMENTS

| | | | |
|---|---|---|---|
| 2,809,686 | 10/1957 | Shepherd | 411/104 |
| 4,500,240 | 2/1985 | Moran et al. | 411/103 |
| 4,583,713 | 4/1986 | Fukura et al. . | |
| 4,934,886 | 6/1990 | Aikens | 411/104 |
| 5,193,643 | 3/1993 | McIntyre | 411/104 |
| 5,346,180 | 9/1994 | Popowich . | |
| 5,356,117 | 10/1994 | Engel . | |

*Primary Examiner*—Robert C. Watson

*Attorney, Agent, or Firm*—Cushman Darby & Cushman Intellectual Property Group of Pillsbury Madison & Sutro, LLP

[57] ABSTRACT

This invention relates to the construction of pantograph jacks and, in particular, relates to the construction of an improved trunnion for connecting the pantograph jack arms to the drive shaft. In particular, a pantograph jack is disclosed that has at least one joint including an end of an upper arm, an end of a lower arm, and a drive screw shaft all connected by a trunnion means. The improved trunnion comprises a rectangular plate having a length extending from a first end to a second end, and including a substantially flat first section, a curved second section folded back over the first section to juxtapose the second end to the first end, and the first section and the second section having first and second holes, respectively, aligned and sized to receive the drive screw shaft for sliding movement.

8 Claims, 3 Drawing Sheets

TUBULAR D-SHAPED TRUNNION

FIELD OF THE INVENTION

This invention relates to the construction of pantograph jacks and, in particular, relates to the construction of an improved trunnion for connecting the pantograph jack arms to the drive shaft.

BACKGROUND OF THE INVENTION

A portable jack is often stored in a vehicle to enable a driver to lift the vehicle to effect emergency repairs, for example, to change a tire. One popular type of jack for automobiles is the pantograph jack which typically has four arms hinged in a parallelogram at four joints. One joint is located on a base of the jack. Another joint is positioned at a load rest vertically above the base. Two other free floating joints are located on a horizontal diagonal at opposite corners of the parallelogram formed by the arms. When the free floating joints are drawn together in a horizontal plane the arms extend vertically to lift the load support with respect to the base and vice versa. The relative position of the free floating joints is controlled by a drive screw which links them together. Each free floating joint has a means to connect an upper arm, a lower arm and the drive screw shaft. For example, each upper and lower arm may have a pair of jaws at one end that close over a pair of trunnions extending laterally from a body containing an annulus to receive the drive shaft in a threaded or unthreaded connection. Hereafter the connection means including the body, trunnions and annulus will be referred to generally as a trunnion.

There are two types of trunnions in a pantograph jack which for convenience will be referred to in this specification as the active and passive trunnions. The active trunnion has a threaded connection with the drive screw shaft to actively advance the trunnion over the drive shaft as it turns within the trunnion. The passive trunnion has a sliding connection with the drive shaft and will be pushed along it by a bearing surface of the shaft abutting the trunnion.

It is an object of this invention to disclose a simplified trunnion design to reduce the manufacturing costs and the weight of existing trunnions while maintaining integrity, strength and utility suitable to such connection means in a pantograph jack.

SUMMARY OF THE INVENTION

The present invention is an improved trunnion for a pantograph jack that has at least one joint including an end of an upper arm, an end of a lower arm and a drive screw shaft all connected by a trunnion. The improved trunnion comprises a rectangular prate having a width slightly greater than said joint so that it projects beyond each side of the joint by an amount equal to 2X. The plate has a length extending from a first end to a second end of the plate. The length includes a substantially flat first section and a curved second section that is folded back over the first section to juxtapose the second end to the first end. The first section and said second section have first and second holes, respectively, that are aligned and sized to receive the drive shaft for sliding movement. The improved trunnion may be located in ends of said arms with the first and second holes about the drive shaft with one half of the excess width ( ie. "X") extending beyond each side of the joint. Then the "X" amount of the width on each side may be upset over each side of the joint to locate said trunnion within the arm ends. It will be appreciated by those skilled in the art that the upsetting of the ends of the trunnion in the joint will be done in a manner to permit the usual movement of the parts with respect to one another. Thus the improved trunnion of this invention may serve as the passive trunnion of a pantograph jack.

In preferred embodiments of the passive trunnion, the second section has a flat positioned about the second hole to receive a bearing surface of the drive shaft that acts on the flat to slide the trunnion over the drive shaft.

In another embodiment the improved trunnion may have a threaded nut inserted into the gap between the first and second sections to receive a threaded portion of the drive shaft in screw connection to become an active trunnion. In this context a "threaded nut" is intended to include any body of a suitable shape to locate within the gap but to be restrained from rotational movement within the gap and having a threaded annulus within it to make a threaded connection with the drive shaft.

DESCRIPTION OF THE FIGURES

In the figures which illustrate a preferred embodiment of this invention.

DESCRIPTION OF THE INVENTION

Figure 1:
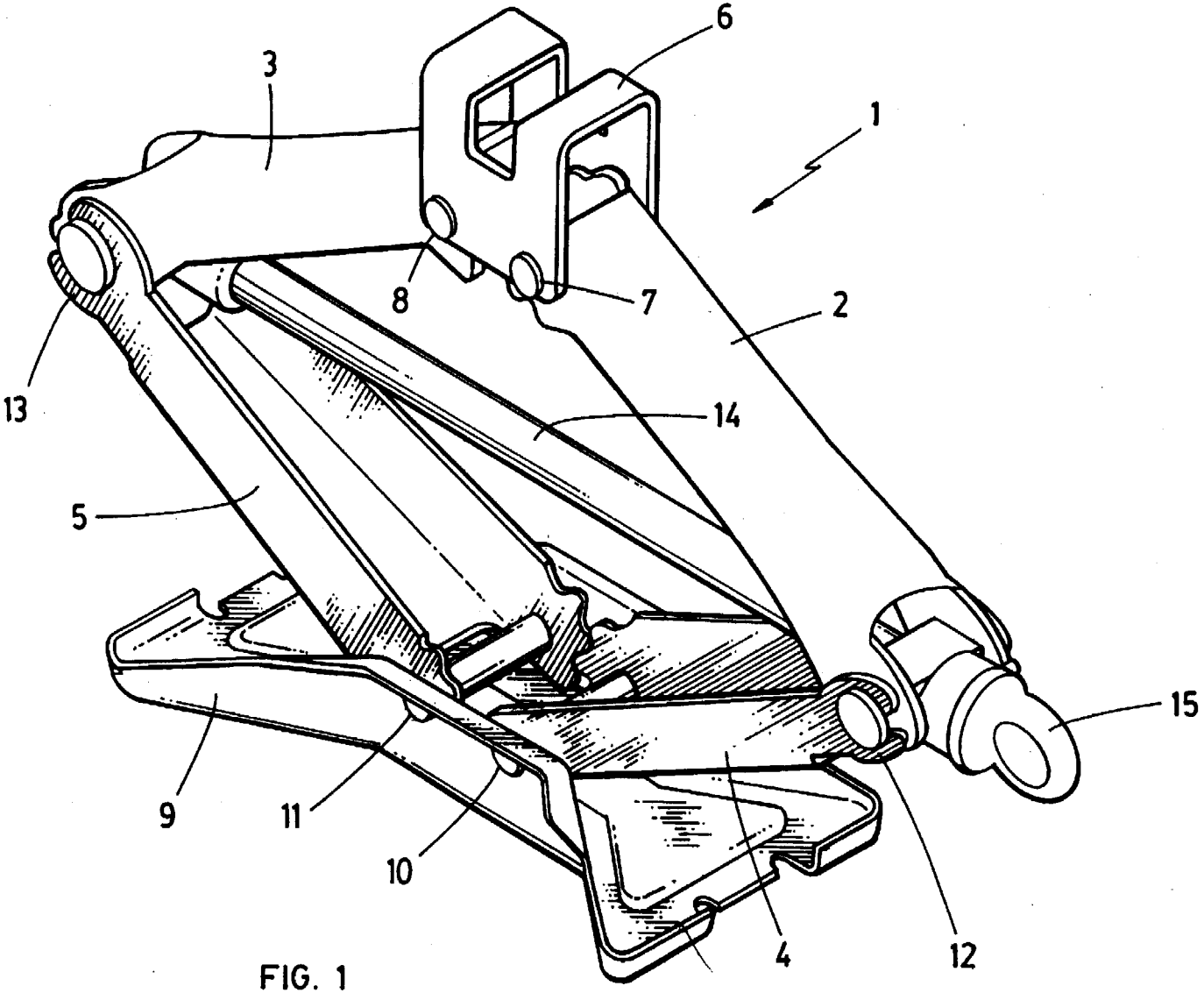
FIG. 1 is an illustration of a typical pantograph jack.

As illustrated in FIG. 1, a pantograph jack 1 typically has four arms namely, a right upper arm 2, a left upper arm 3, a right lower arm 4, and a left lower arm 5. The upper arms 2 and 3 are hinged in a load rest 6 at holes 7 and 8, respectively. The lower arms 4 and 5 are hinged in a base 9 at holes 10 and 11, respectively. (It will be appreciated that there are corresponding holes 7', 8', 10', and 11' on the other side of the jack.) Two free floating joints 12 and 13 are located on a horizontal diagonal at opposite corners of the parallelogram formed by the arms 2, 3, 4 and 5. The horizontal position of the free floating joints 12 and 13 and, accordingly, the vertical position of the load rest 6 relative to the base 9 is controlled by a drive screw 14 which links joints 12 and 13 together. At joint 12, a trunnion 15 links the lower arm 4 and the upper arm 2 and receives the drive shaft 14 in an unthreaded or passive connection. At joint 13, a trunnion 16 links the upper arm 3 and the lower arm 5 and receives the drive shaft 14 in a threaded or active connection. The drive shaft 14 is driven by a crank or other means (not shown and not material to the invention) which connects to an eye connection at the end of the drive screw 14. The eye connection bears on the trunnion 15 to force it inward while the drive shaft 14 turns within threaded trunnion 16 to force the jack 1 upwards. Similarly, the trunnion 15 is released (or pushed by another bearing surface on the shaft 14) outwardly as shaft 14 is reversed to lower the jack 1.

Figure 2:
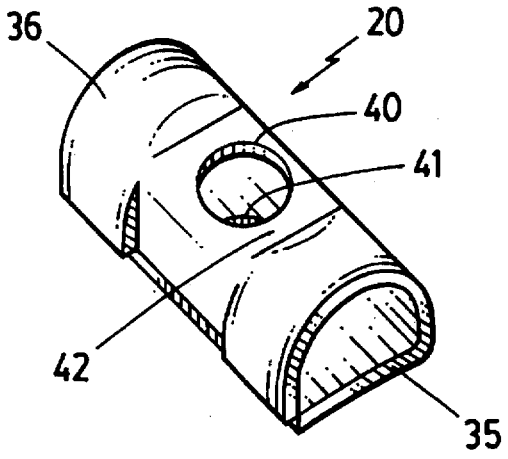
FIG. 2 is a perspective illustration of the trunnion of this invention.
Figure 3:
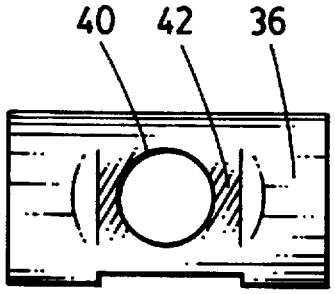
FIG. 3 is a top view of the trunnion of this invention.
Figure 4:
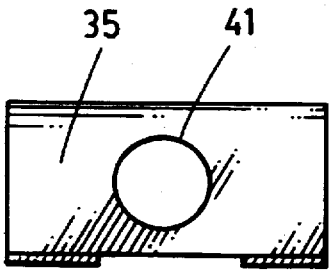
FIG. 4 is a bottom view.
Figure 5:
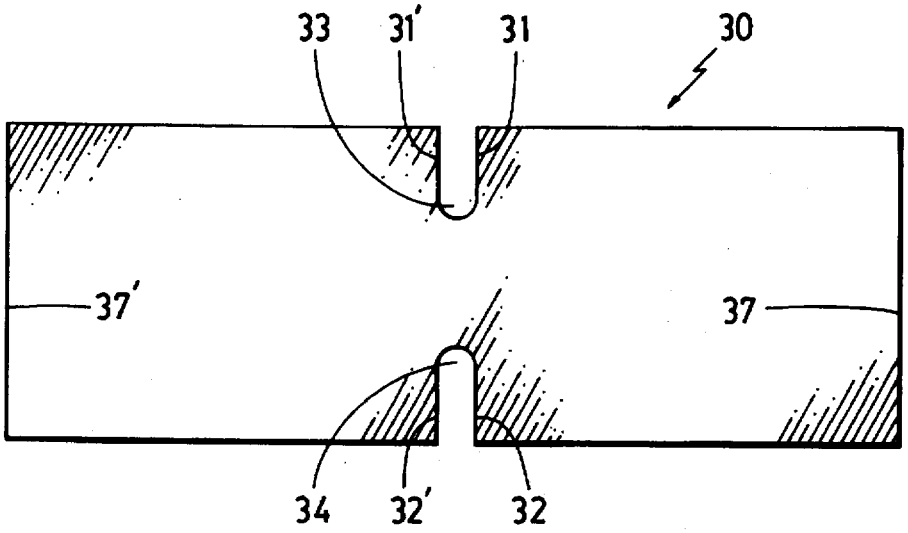
FIG. 5 is a plate from which two D-shaped trunnions may be manufactured.

The preferred embodiment of the novel "D"-shaped trunnion 20 of this invention is illustrated in FIGS. 2–4. While in the general description above the trunnion has been described in terms of a single plate, it will be appreciated by skilled persons that many different manufacturing processes could be invoked to manufacture the trunnion. In a preferred manufacturing process, two such trunnions are fabricated from a single flat plate 30 in the manner shown in FIGS. 5–6 by bending and cutting.

Figure 6:
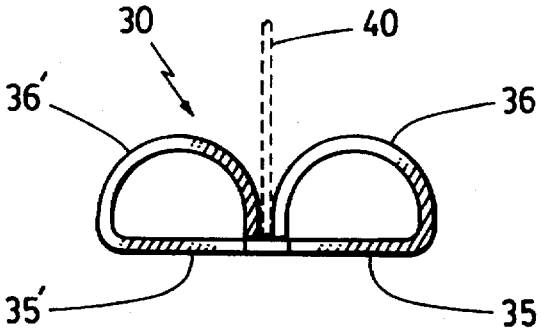
FIG. 6 is a an illustration of the first bending and cutting operation.

In such preferred process, the plate 30 has a width greater than the width of the arms of the jack 1 so that it may extend through a free floating joint 12 or 13 with a sufficient excess of width that part of the excess may extend beyond each side of the joint and be upset to secure the trunnion 20 in the arms of the joint. On a line traversing the middle of the length of the plate 30, two partial cuts 31 and 32 terminate in two holes 33 and 34, respectively. As shown in FIG. 6, each plate end 37 and 37' is bent upwards, towards the middle and downwards to form two curved second sections 36 and 36' that are folded back over two flat first sections 35 and 35' with the plate ends 37 and 37' juxtaposed to middle cuts 31 and 32. The plate 30 is then cut through its centre by cutter 40 to form two trunnions 20.

In each trunnion 20, as shown in FIGS. 2–4, the first section 35 and said second section 36 have first and second holes 40 and 41, respectively, that are aligned to receive a drive screw through them. The second section 36 may also have a flat 42 stamped about said second hole to receive a bearing surface.

Figure 7:
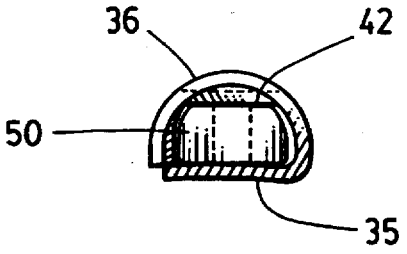
FIG. 7 is a side view of the D-shaped trunnion of this invention.

In the active trunnion embodiment shown in FIG. 7 a nut 50 is placed in the gap between the first and second sections 35 and 36 to receive the drive shaft 14 in threaded connection. The nut 50 is sized to fit within the gap but without sufficient clearance to rotate within the gap. Thus the drive screw 14 may turn within the nut 50 to drive the trunnion along its length. The word "nut" is used in the sense of any threaded body which so fits within the gap and in threaded connection about the drive screw.

The foregoing description of the preferred embodiments of this invention is directed to one skilled in the art and is explanatory rather than limiting of the features of this invention and its manufacture. Equivalents and substitutions that are obvious to skilled persons reading this specification in view of the prior art are intended to be included for all parts described. Dimensions and shapes of the parts shown in the drawings are not essential and may be adapted in accordance with usual engineering practice as is appropriate to particular end uses. Obviously unsuitable materials and dimensions are intended to be excluded.

What I claim is:

1. For use in a pantograph jack that has at least one joint including an end of an upper arm, an end of a lower arm and a drive screw shaft all connected by a trunnion means, an improved trunnion comprising a rectangular plate having a length extending from a first end to a second end and including a substantially flat first section, a curved second section folded back over the first section to juxtapose the second end to the first end, said first section and said second section having first and second holes, respectively, aligned and sized to receive said drive screw shaft for sliding movement, wherein said plate has a width slightly greater than said joint by an amount equal to 2X so that an "X" amount of the width may upset over each side of the joint to locate said trunnion within said arm ends.

2. The trunnion of claim 1 in which said second section has a flat about said second hole to receive a bearing surface of said drive shaft to slide the trunnion over the drive shaft.

3. An improved trunnion for a pantograph jack that has at least one joint including an end of an upper arm, an end of a lower arm and a drive screw shaft all connected by a trunnion, said improved trunnion comprising of a rectangular plate, having a length extending from a first end to a second end and including a substantially flat first section, a curved second section folded back over the first section to juxtapose the second end to the first end, said first section and said second section having first and second holes, respectively, aligned and sized to receive said drive shaft and having a threaded nut between said first and second sections to receive a threaded portion of the drive shaft in screw connection, wherein said plate has a width slightly greater than said joint in an amount equal to 2X so that the improved trunnion may be located in ends of said arms with an "X" amount of the width upset over each side of the joint to locate said trunnion within said ends.

4. An improved trunnion for a pantograph jack that has at least one joint including an end of an upper arm, an end of a lower arm and a drive screw shaft all connected by a trunnion assembly, the improved trunnion having a generally tubular, D-shape and comprising a substantially flat first section and a curved second section, said flat first section having a first end edge and a fold end, said second section being formed integrally with said first section and extending from said fold end of said first section to a second end edge, at least a portion of said second end edge engaging said first section whereby said curved second section withstand loads imposed by the jack and said flat first section reinforces said curved second section, said first section and said second section having first and second holes, respectively, aligned and sized for receiving said drive screw shaft for sliding movement therethrough.

5. The improved trunnion of claim 4 in which said portion of said second end edge of said second section engages said first section substantially at said first end edge.

6. The improved trunnion of claim 4 in which said plate has a width slightly greater than said joint by an amount equal to 2X so that an "X" amount of the width may upset over each side of the joint to locate said trunnion within said arm ends.

7. The trunnion of claim 4 in which said second section has a flat portion about said second hole to receive a bearing surface of said drive shaft.

8. The trunnion of claim 4 in which the first section has first and second major surfaces, said first surface facing said second section, said portion of said second end edge abutting a portion of said first surface.

* * * * *